US006413369B2

(12) United States Patent
Kinnunen

(10) Patent No.: US 6,413,369 B2
(45) Date of Patent: Jul. 2, 2002

(54) ARRANGEMENT AND METHOD FOR FORMING A MULTILAYERED PAPER OR PAPERBOARD WEB

(75) Inventor: Jukka Kinnunen, Pohjanaho (FI)

(73) Assignee: Metso Paper Karlstad AB, Karlstad (SE)

( * ) Notice: Subject to any disclaimer, the term of this patent is extended or adjusted under 35 U.S.C. 154(b) by 0 days.

(21) Appl. No.: 09/738,495

(22) Filed: Dec. 15, 2000

Related U.S. Application Data

(60) Provisional application No. 60/171,974, filed on Dec. 23, 1999.

(30) Foreign Application Priority Data

Dec. 15, 1999 (SE) ..... 9904605

(51) Int. Cl.[7] ..... D21F 1/00

(52) U.S. Cl. ..... 162/130; 162/203; 162/304

(58) Field of Search ..... 162/123, 132, 162/133, 274, 298, 299, 300, 303, 304, 381, 301, 302, 124, 125, 129, 130, 131, 203

(56) References Cited

U.S. PATENT DOCUMENTS 1,722,503 A * 7/1929 Millspaugh ..... 162/132
2,881,669 A * 4/1959 Thomas et al. ..... 162/130
4,074,959 A * 2/1978 Curry et al. ..... 425/81.1
4,830,709 A * 5/1989 Turner et al. ..... 162/133
5,468,348 A * 11/1995 Blackledge et al. ..... 162/132
5,584,967 A * 12/1996 Grossmann et al. ..... 162/304
5,607,555 A * 3/1997 Grossmann et al. ..... 162/304
6,159,341 A * 12/2000 Egelhof et al. ..... 162/303

OTHER PUBLICATIONS

PCT International–Type Search Report, Swedish National Application No. 9904605–4, completed on Aug. 23, 2000.

* cited by examiner

*Primary Examiner*—Peter Chin
*Assistant Examiner*—Eric Hug
(74) *Attorney, Agent, or Firm*—Alston & Bird LLP

(57) ABSTRACT

An arrangement and method for forming a multilayered paper or paperboard web from stock suspensions containing papermaking fibers and fines, in which first and second webs are formed in first and second twin-wire forming units such that each web has a higher concentration of fines at one side than at the other side of the web. The webs are couched together such that the sides having the higher concentration of fines are in contact with each other.

25 Claims, 6 Drawing Sheets

ARRANGEMENT AND METHOD FOR FORMING A MULTILAYERED PAPER OR PAPERBOARD WEB

CROSS-REFERENCE TO RELATED APPLICATION

This application claims the benefit of U.S. Provisional Application No. 60/171,979, filed Dec. 23, 1999.

TECHNICAL FIELD

The present invention relates to an arrangement for forming a multilayered paper or paperboard from stock suspensions with papermaking fibres and fines, said arrangement including at least a first and a second forming unit, at least one of the forming units being of twin wire type and having a forming roll for foaming a fibrous web having a higher content of fines u one side than at the other, and a couch device for couching together said fibrous web having a higher content of fines at one side with an other fibrous web to form the multilayered web.

The invention relates to a method of a multilayered paper or paperboard web from stock suspensions with papermaking fibres and fines, said method including the steps of:

forming a first fiber web having a higher content of fine& at one side than at the other in a first forming unit of twin wire type and having a forming roll, forming a second fiber web in a second forming unit, and couching the formed webs together to form the multilayered web.

The invention is particularly advantageously implemented when forming testliner, fluting, liner, white-top liner, gypsum board liner, and paperboard based on recycled pulp fibres. However, the invention also can be implemented when forming other paper or paperboard webs.

BACKGROUND OF THE INVENTION

When manufacturing multilayer liner and paperboard, it is previously known to form bottom layer and top layer(s) for example in so-called fourdrinier forming units, or alternatively in twin-wire forming units of a paper or paperboard machine, in order to subsequently couch the layers together into a coherent web, which is pressed in a press section and dried in a drying section.

It is also previously known that forming the top and bottom layers in fourdrinier forming units, as a rule, results in a finished product with a higher internal bond strength, i.e. bond strength between the layers, than what is achievable if the top and bottom layers arc formed in twin-wire forming units.

The patent publication DE 2 020 688 disclose& a method for joining two webs of paper, paperboard or the like, more specifically a couchinig method, and a device for implementing the method. The method comprises that the two web& ran in the same direction during their manufacture and are joined in a such a way that the wire-side of the secondary web comes to rest on the top side of the primary web.

The device disclosed in DE 2 020 688 comprises a movable long wire (fourdrinier) as a primary wire, and at least one wire arranged in circulation above the long wire as a secondary wire. In the lowest portion of its path, each wire runs in the opposite direction in relation to the long wire, wherein each wire in circulation has been supplied with a transfer roll which is arranged so that it contacts the wire in circulation on an outer side and the long wire on its top side. Thereby, according to DE 2 020 688, the advantage is obtained that always one surface of a paper web manufactured through the method will exhibit the properties of a sheet top-side, such as an improved printability in comparison with a wire-side, wherein this is also the case if more than two paper webs are joined by means of the method.

The patent publication DE 40 31 038 A 1 discloses a device for manufacturing a multilayer paper or multilayer paperboard by means of a primary wire, and a secondary wire arranged above this as twin-wire forming unit, which forms a top layer of the multilayer paper or paperboard onto a bottom layer. Thereby, the twin-wire forming unit has a forming roll as a breast roll for configurating the twin-wires. Upstream the forming roll, a pressure application unit is arranged, wherein the waterline of the pulp suspension is within the region of the forming roll. According to DE 40 31 038 A 1, amongst other things, the disclosed device makes it possible to obtain a higher internal bond strength, since the dry content of the top layer is relatively low when the couching to the bottom layer takes place.

Furthermore, the patent publication U.S. Pat. No. 5,607,555 discloses a forming section of a paper machine having two twin-wire forming units for forming a multilayer web. Each twin-wire forming unit consists of a headbox, two wire loops arranged to define a common wire path for molding the web being formed in a sandwich-like manner, and drainage elements for each of the wire loops. The common wire path of each forming unit has a first section including a curved suction drainage element or roll in the first lower wire loop, and a second section including opposing drainage ledges. Thereby, the drainage ledges are stationary at the upper side and designed to be resiliently pressable on the bottom side. The drainage ledges of the upper and lower sides are arranged staggered with respect to each other in the direction of travel of the wire, wherein at least the ledges of the upper side are designed for suction. Furthermore, there is at least one third section which has at least one suction wire-separating element on one side. The twin-wire forming units are arnnnged so that tee same drainage elements are associated in each case with what will be the inner and the outer sides of each layer in the multilayer web. According to U.S. Pat. No. 5.607,555, a very uniform paper is obtained in this way. Furthermore, its is reported that the contents of filler and/or fines can be displaced towards the outsides of the layers of the paper web by means of arranging the drainage ledges in a suitable way, depending on the prevailing requirements. As a result of this, a larger number of fibres are believed to be present on the two sides of the layers which rest against each other, wherein a better adhesion between the layers is obtained when they have been couched together.

However, it has been found that multilayered paper or paperboard which has been formed in the previously known arrangements can have an insufficient internal bond strength in the z-direction.

One reason for this is that many of the previously known arrangements utilise drainage elements of such types which generate very high shear forces in the pulp suspensions which are dewatcrred Examples of such drainage elements are vactiuum forming rolls and suction boxes with drainage foils generating a high vacuum. High shear forces in the pulp suspensions result in a low retention of the fine material (fines) which is important in order to obtain a high internal bond strength, or at least result in the fines content being strongly reduced at the side of a paper or paperboard laye which has been facing such a drainage element during the dewatering. This often makes it difficult to obtain a sufficient internal bond strength of the finished paper or the finished paperboard.

SUMMARY OF THE INVENTION

Accordingly, a first object of the present invention is to provide an arrangement for forming a multilayered paper or paperboard web, which arrangement maxinises the amount of fines which is retained when forming the layers included in the web, and ensures that those sides of the layers which have the highest content of fines are couched together with each other, so that the multilayered paper or paperboard web obtains a raised internal bond strength.

In accordance with claim 1, this first object of the present invention is achieved in that both of the forming units are of twin wire type and include a forming roll for forming a fibrous web having a higher content of fines at one side than at the other, and that the two forming ae so arranged relative to each other as to place the web sides having the highest content of fines in contact with each other for couching together to form the multilayered web.

According to a preferred embodiment of the invention, the forming rolls are open and adapted for making the content of fines in the fibre webs higher at the inner-wire side than at the outer wire-side during the initial dewatering, wherein the additonal drainage members are adapted for maintaining the content of fines at least substantially unchanged at a high level at the inner-wire side during the continued dewatering, and the forming units are designed and arranged in relation to each other so that the two formed fibre webs are joined with the inner-wire sides against each other.

A second object of the present invention is to provide a method for forming a multilayered paper or paperboard web which method maximises the amount of fines that is retained when forming the layers included in the web, and ensures that those sides of the layers that have the highest content of fines are couched together with each other, so that the multilayer paper or paperboard web obtains a raised internal bond strength.

In accordance with claim 14, this second object of the present invention is achieved by:

using as second forming unit a twin wire forming unit having a forming roll, forming also the second fiber web with a higher content of fines at one side than at the other, and positioning the webs so as to ensure that those sides of the webs, which have the highest content of fines, are couched together to form the multilayered web.

According to a preferred embodiment of the invention, the method additionally includes the steps of chosing open forming rolls for the initial dewatering, adapting them so that the content of fines in the fibrous webs becomes at least as high at the inner wire side as at the outer wire aide during the initial dewatering, adapting the additional drainage members so that the content of fines will be maintained at least substantially unchanged at a high level at the inner wire side during ghe continued dewatering, and joining the two formed fibrous webs with the inner wire sides against each other.

It should be noted that the expression "open forming rolls", as used herein, means that a two-sided dewatering on the forming rolls, if possible, is accomplished without the application of any external suction.

When the wire speed of a twin-wire forming unit is increased, as is well-known to the skilled person, a stage will be reached where the g-force becomes so large that the inwardly directed pressure generated by the tension in the outer-wire no longer is able to press any water through the inner-wire, so that all dewatering will take place through the outer-wire. In such cases, it may become necessary to generate a negative pressure within the forming roll in order to be able to direct at least part of the dewatering through the inner-wire. An entirely symmetrical dewatering would be possible to achieve only in cases where there were no g-forces at all.

For this reason, the expression "open forming rolls", as used herein, is also intended to include embodiments of the invention where a suction forming roll with a low, or at the most, a moderate negative pressure is utilised in order to prevent all dewatering from taking place through the outer-wire at high wire speeds, but in which embodiments the main drainage impulse still is generated by the wire tension during the passage of the wires over the curved peripheral surface of the forming roll.

Further objects of the present invention will become evident from the following description, while the features which enables the further objects to be achieved are defined in the dependent claims.

BRIEF DESCRIPTION OF THE DRAWINGS

In the following, the invention will be described in greater detail with reference to the attached drawings, in which.

DETAILED DESCRIPTION OF PREFERRED EMBODIMENTS

Figure 1:
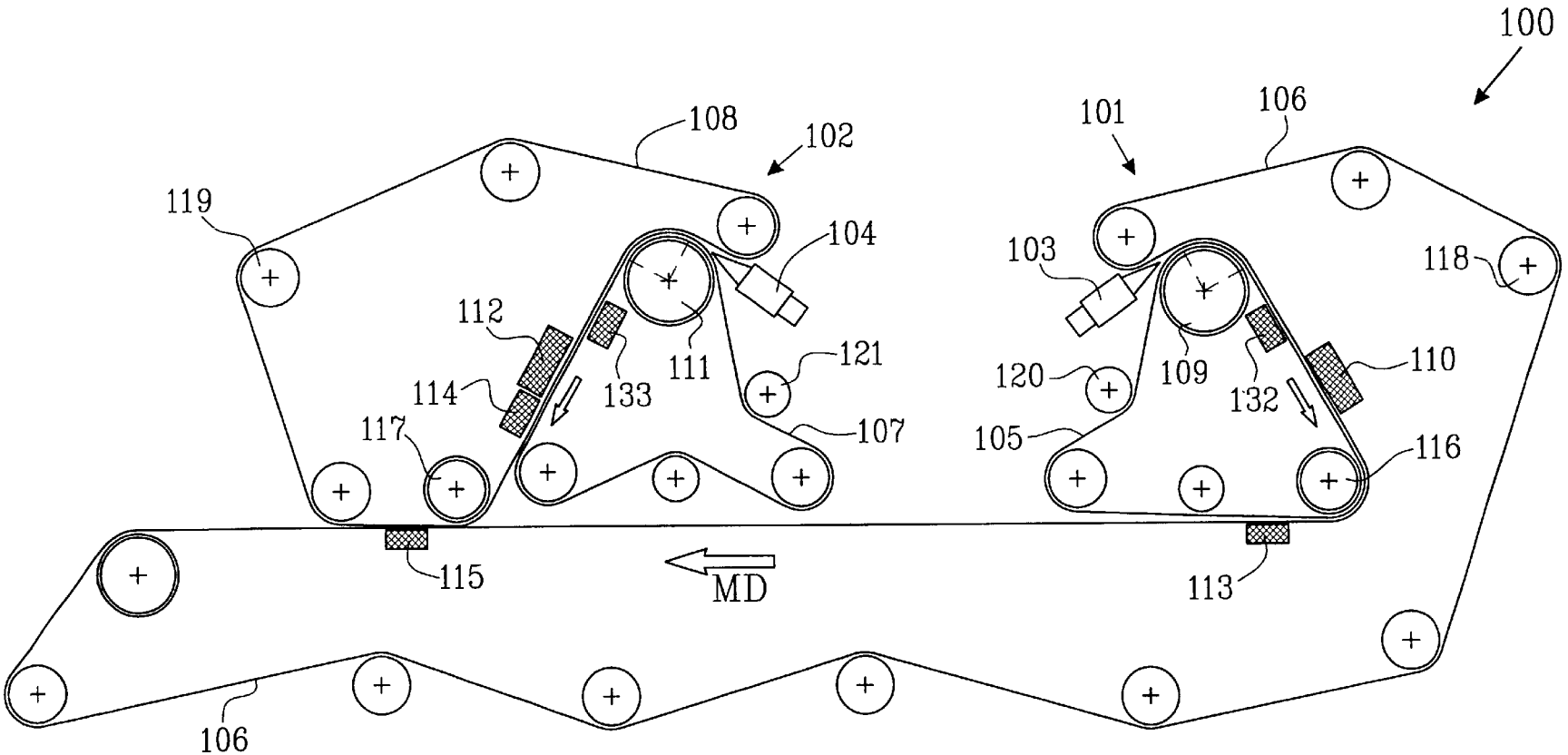
FIG. 1 shows a simplified and schematic side view of an arrangement according to the invention in a first advantageous configuration.

In the following, a number of different embodiments of the arrangement according to the invention will be, described, and when applicable with reference to the attached FIGS. 1–7.

The arrangement according to the invention comprises a first 101; 201; 301; 401 and a second forming unit 102; 202; 302; 402, wherein each forming unit is of a twin-wire type and has a forming roll 109; 209; 309; 409 and 111: 211; 311; 411, and an inner-wire 105; 205; 305; 405 and. 107; 207; 307; 407 and an outer-wire 106; 206; 306; 406 and 108; 208;

308; 408 enclosing a portion of the circumference of each respective forming roll and thereby forming an initial, curved section of a forming zone for an initial dewatering and forming of a fibre web A and B, having an inner-wire side x and z supported by the inner-wire and an outer-wire side y and w supported by the outer-wire. The curved section is followed by a section with additional drainage members 110; 210; 310; 410 and 112; 212; 312; 412 for a continued dewatering of the formed fibre web A and B, wherein vacuum transfer means 113, 114, 115; 213, 214, 215; 313, 314, 315, 327; 413, 414, 415, 427 are arranged for joining the fibre webs A, B in order to form a multilayered fibre web C, which is intended to be included in or to constitute the multilayered paper or paperboard web D after pressing and drying.

Thereby, according to the invention, the forming rolls 109, 111; 209, 211; 309, 311; 409, 411 are open, and adapted to make the content of fines in the fibre webs A, B higher at the inner-wire side x and z than at the outer-wire side y and w during the initial dewatering, while the additional drainage members 110, 112, 210, 212; 310, 312; 410, 412 are adapted for maintaining the content of fines at least substantially unchanged at a high level at the inner-wire side x and z during the continued dewatering, and the forming units 101; 201; 301; 401 and 102; 202; 302; 402 are designed and arranged relation to each other so that the two formed fibre webs A, B are joined with the inner-wire sides x and z against each other.

The above-mentioned open forming rolls of the arrangement according to the invention are adapted in order to provide a "gentle" dewatering, substantially without any shear forces, contrary to what is the case with vacuum or suction forming rolls of arrangements according to prior art, and enabling a high proportion of the supplied fines in the pulp suspensions to remain in the suspensions all the way to the continued dewatering. However, a certain redistribution of the fines in a direction towards the forming rolls can occur in the pulp suspensions.

The specially adapted additional drainage members of the arrangement according to the invention do not comprise any elements at the inner-wire sides which generate high shear forces, such as drainage foils and the like. This is the reason why the main proportion of the fines are retained at the inner-wire sides also during the continued dewatering. During the continued dewatering, a minor portion of the fines can be suctioned out from the pulp suspensions on the side, i.e. the outer-wire side, where the additional drainage members preferably all are arranged in the arrangement according to the invention. The arrangement according to the invention maximises the quantity of fines which is retained when forming the layers included in the web, and ensures that those sides of the layers which have the highest content of fines, i.e. the inner-wire sides, are couched together with each other so that the resulting multilayered paper or paperboard web obtains an increased internal bond strength in comparison to paper or paperboard webs which have been formed in arrangements according to prior art.

In a particularly preferred embodiment, the above-mentioned additional drainage members 110, 112; 210, 212; 310, 312; 410, 412 am arranged for completing the forming of the fibre webs A and B. In this context, the forming can be regarded as completed when the main part of all free water has been removed, so that a coherent paper sheet has been formed. In this embodiment, the additional drainage members are all arranged at the outer-wires 106, 108; 206, 208; 306, 308; 406, 408 for dewatering the fibre webs from the outer wire-sides y and w.

The above-mentioned additional drainage members 110, 112; 210, 212; 310, 312; 410, 412 particularly advantageously comprise vacuum suction boxes with one or several vacuum zones adapted in order to remove substantially all free water from the fibre webs A and B before the joining. However, within the scope of the invention, it is also conceivable with embodiments with other types of additional drainage members.

Figure 7:
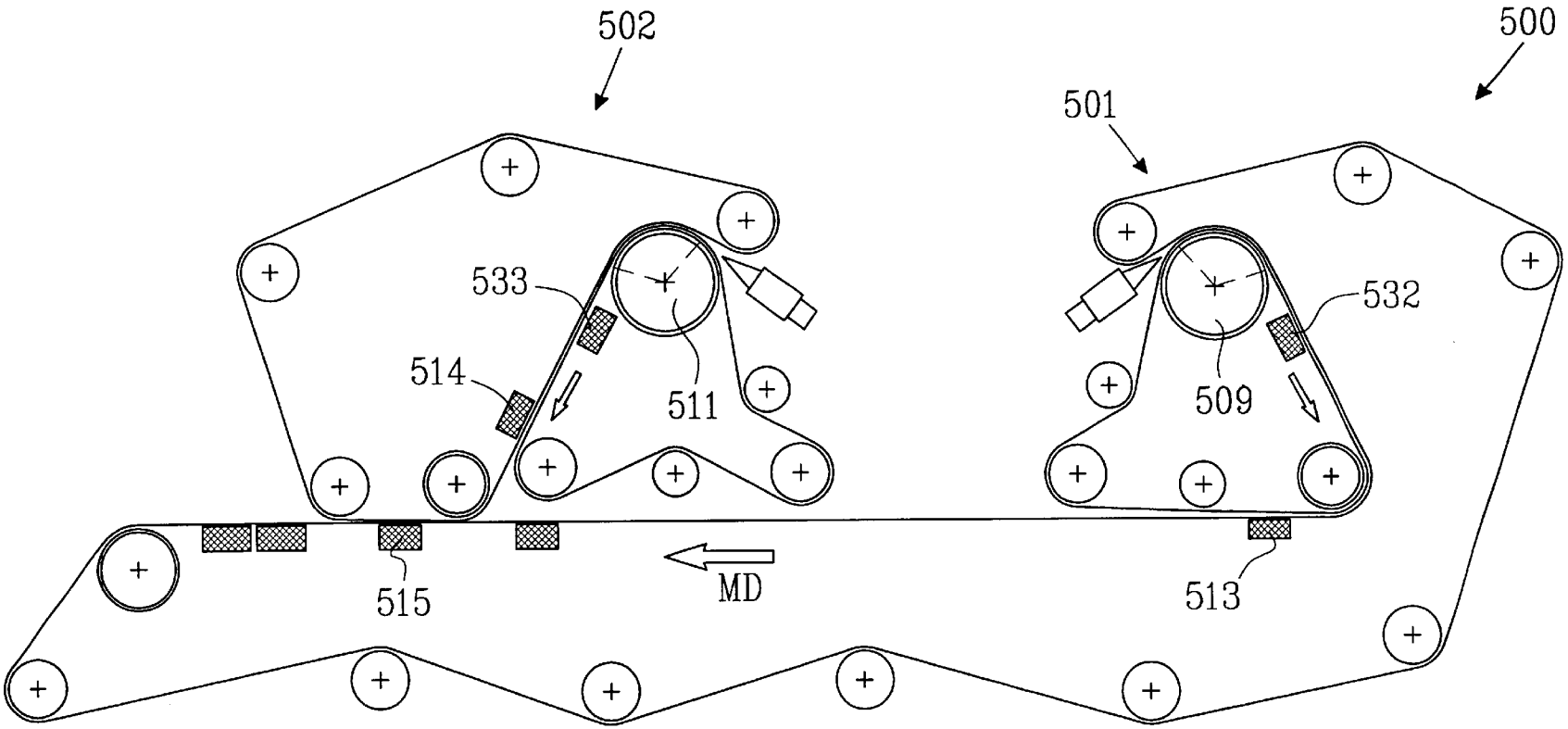
FIG. 7 shows a simplified and schematic side view of an arrangement according to a preferred embodiment of the invention.

In one advantageous embodiment of the arrangement 500 according to the invention, particularly illustrated by FIG. 7, the forming rolls 509, 511 have a diameter of about 1.4–1.8 m, and are arranged with a wire winding angle which is at least 80° for the initial dewatering. Thereby, one or several of the vacuum transfer means 513, 514 are arranged in order to constitute the additional drainage members for the continued dewatering. Accordingly, the arrangement according to this embodiment comprises forming rolls having a large diameter and a large wire winding angle, something which provides an efficient dewatering and a very high dryness already after the initial dewatering. This embodiment enables a simplified arrangement, since the continued dewatering, and the web transfer between the wires are provided by the same members.

According to another advantageous embodiment, the arrangement comprises headboxes 103, 104; 203, 204; 303, 304; 403, 404, forming rolls 109, 111; 209, 211; 309, 311; 409, 411, additional drainage members 110, 112; 210, 212; 310; 312; 410, 412, and preferably alto wires 105, 107; 205, 207; 305, 306, 307, 308; 405, 406, 407, 408, which are identical in the first 101; 201; 301; 401 and in the second 102; 202; 302; 402 forming unit. This embodiment provides large cost advantages, since the number of spare parts in stock can be minimised.

In an even more advantageous embodiment, the arrangement further comprises drive rolls 116, 117; 216, 217; 316,317; 416, 417, guide rolls 118, 119; 218, 219; 318, 319; 418, 419 and tensioning rolls 120, 121; 220, 221; 320, 321; 420, 421 which are identical in the first 101; 201; 301; 401 and the second 102; 202; 302; 402 forming unit. Thereby, it is of course also conceivable with embodiments in which the guide rolls are driven, or where the tensioning rolls function as guide rolls. This embodiment enables very low costs for keeping spare parts in stock.

In a particularly advantageous embodiment, the first 101; 201; 301; 401 and the second 102; 202; 302, 402 forming unit are substantially mirror-invertedly identical.

Figure 2:
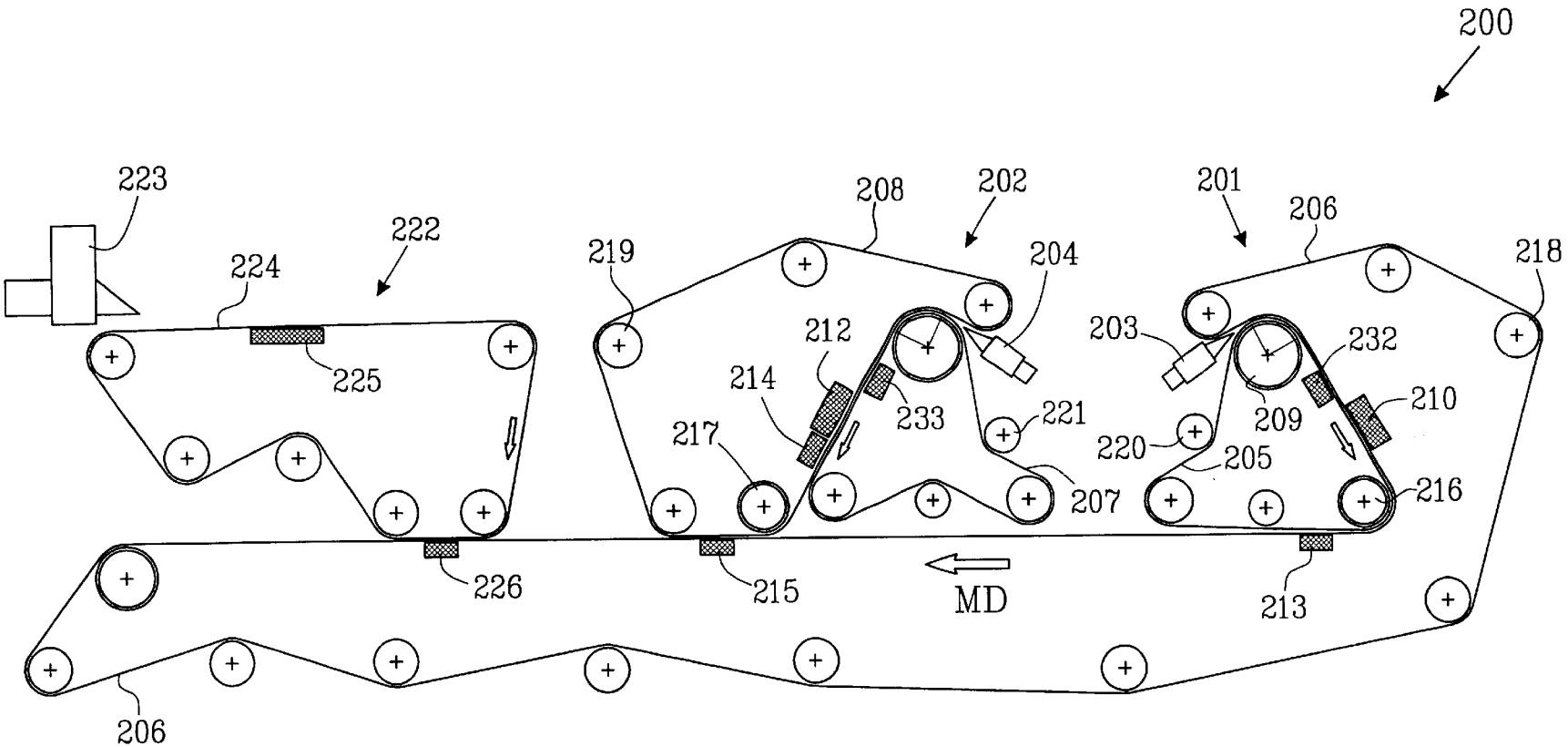
FIG. 2 shows a simplified and schematic side view of an arrangement according to the invention in a second advantageous configuration.
Figure 5:
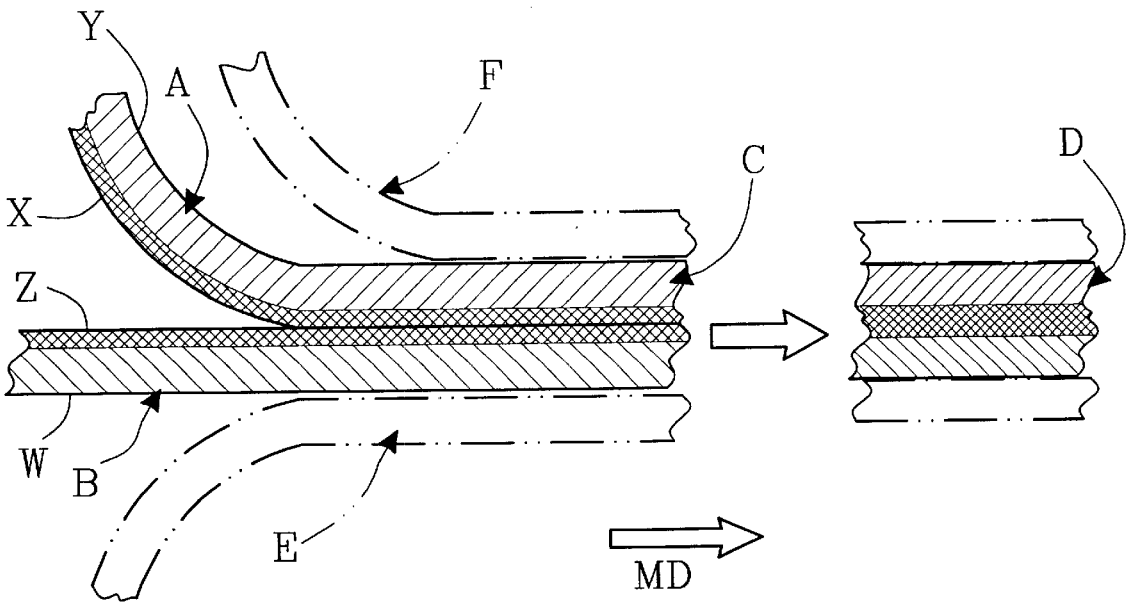

In a first alternative embodiment, particularly illustrated by FIGS. 1 and 2 together with FIG. 5, the arrangement for comprises a first vacuum transfer means 113; 213 arranged for transferring a first fibre web A from the inner-wire 105; 205 to the outer-wire 106; 206 of the first forming unit 101; 201, a second vacuum transfer means 114; 214 arranged for transferring a second fibre web B from the inner-wire 107; 207 to the outer-wire 108; 208 of the second forming unit 102; 202, and a third vacuum transfer means 115; 215 arranged for transferring the second fibre web B from the outer-wire 108; 208 of the second forming unit 102; 202 onto the first fibre web A in order to form the multilayered fibre web C. In the described embodiment, these vacuum transfer means does not have as their task to achieve any dewatering, they are only intended to transfer a fibre web from one wire to another.

Figure 3:
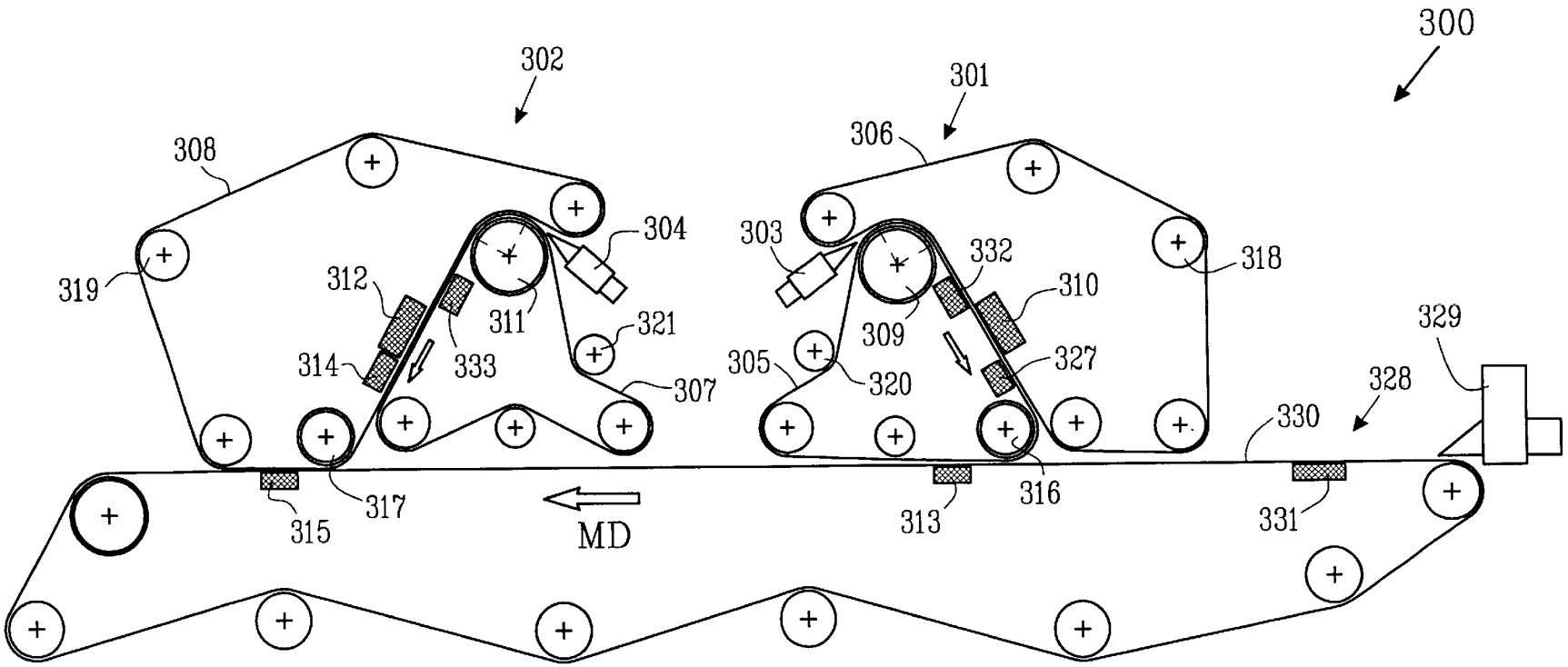
FIG. 3 shows a simplified and schematic side view of an arrangement according to the invention in a third advantageous configuration.
Figure 4:
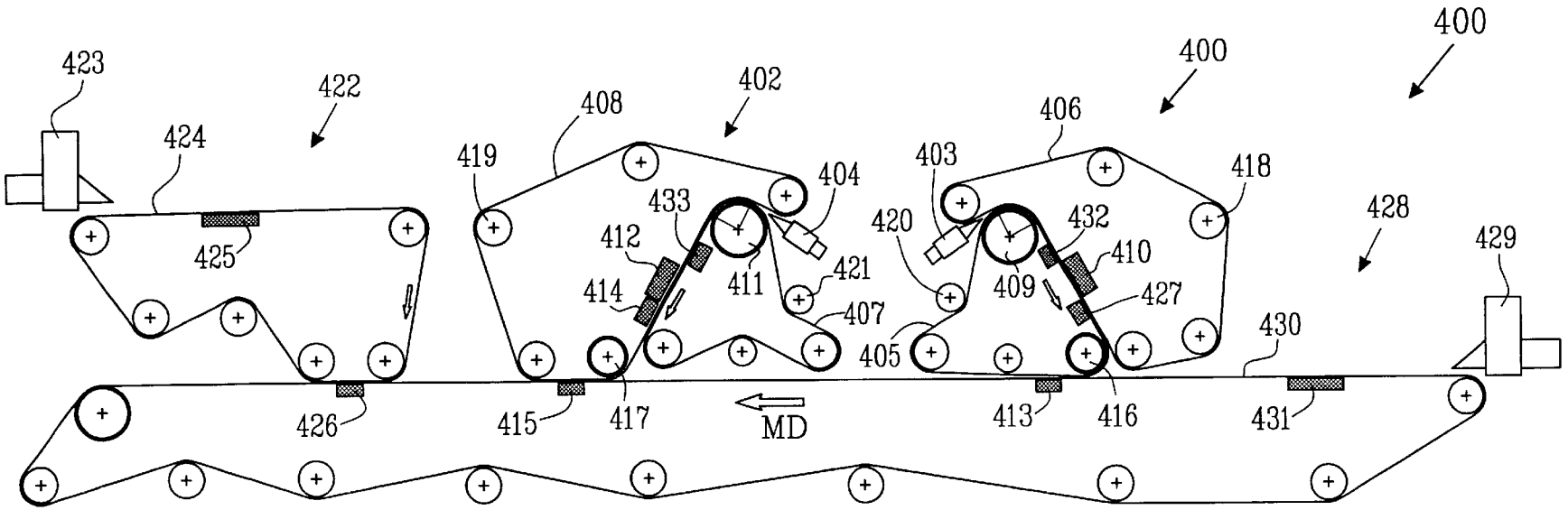
FIG. 4 shows a simplified and schematic side view of an arrangement according to the invention in a fourth advantageous configuration, FIG. 5 schematically illustrates some main steps in a method according to a preferred embodiment of the invention, FIG. 6 in diagram form illustrates the relative percentage of fines as a function of the thickness Z of a first fibre web from bottom BO to top TO, wherein the first fibre web has been formed in a forming unit of an arrangement according to the invention, and a test specimen for analysis of the fines content has been extracted before the joining to a second fibre web.

In a second alternative embodiment, particularly illustrated by FIGS. 3 and 4 together with FIG. 5, the arrangement 300; 400 comprises a bottom layer forming unit 328; 428 having an additional headbox 329; 429 for forming a bottom layer E onto at least one bottom-wire 330; 430, wherein at least one vacuum transfer means 313; 413 is arranged for transferring the first fibre web A onto the bottom layer E on the bottom-wire 330; 430. In this embodiment, he arrangement 300; 400 particularly advantageously comprises at least one additional vacuum transfer means 327; 427 arranged for transferring the first fibre web A from the outer-wire 306:406 to the inner-wire 305; 405 of the first forming unit 301; 401. The bottom layer forming unit of course also comprises suitable drainage members 331; 431.

In a third, alternative embodiment, particularly illustrated by FIGS. 2 and 4 together with FIG. 5, the arrangement 200; 400 further comprises a top layer forming unit 222; 422 having an additional headbox 223; 423 for forming a top layer F on at least one top-wire 224; 424, and an additional vacuum transfer means 226; 426 arranged for transferring the top layer F onto the second fibre web B in order to form the multilayered fibre web C. Also the top layer forming unit of course comprises suitable drainage members 325; 425.

The above-mentioned vacuum transfer means or additional vacuum transfer means of the arrangement according to the invention preferably comprises vacuum suction boxes 113, 114, 115; 213, 214, 215, 226; 313, 314, 315, 327; 413, 414, 415, 426, 427 and/or vacuum suction rolls.

In the following, a number of different embodiments of a method for forming a multilayered paper or paperboard web according to the invention will be described, when applicable with reference to the attached FIGS. 1–7.

The method according to the invention comprises that pulp suspensions with pulp fibres and fines am dewatered in a first 101; 201; 301; 401 and a second 102; 202; 302; 402 forming unit. Each forming unit is of a twin-wire type and has a forming roll 109; 209; 309; 409 and 111; 211; 311; 411, and an inner-wire 105: 205; 305; 405 and 107; 207; 307; 407 and an outer-wire 106; 206; 306; 406 and 108; 208: 308; 408 enclosing a portion of the circumference of each forming roll, and thereby forming an initial, curved section of a forming zone in which initial dewatering and forming is performed of a fibre web A and B having an inner-wire side x and z supported by the inner-wire and an outer-wire side y and z supported by the outer-wire. Thereafter, in a section downstream the curved section, a continued dewatering of the formed fibre web A. B is performed by means of additional drainage members 110; 210; 310; 410 and 112; 212; 312; 412, whereafter the fibre webs A, B are joined by means of vacuum transfer means 113, 114, 115; 213, 214, 215; 313, 314, 315, 327; 413, 414, 415, 427 in order to form a multilayered fibre web C, intended to be included in or to constitute the multilayered paper or paperboard web D after pressing and drying.

According to the invention, open forming rolls 109, 111; 209, 211; 309, 311; 409, 411 are chosen for the initial dewatering and are adapted so that the content of fines in the fibre webs A, B becomes at least as high at the inner-wire side x and 2 as at the outer-wire side y and w during the initial dewatering, while the additional drainage members 110, 112; 210, 212; 310, 312; 410, 412 are adapted so that the content of fines is maintained at least substantially unchanged at a high level at the inner-wire side x and z, and wherein the two formed fibre webs A. B are joined with their inner-wire sides x and z against each other.

In an advantageous embodiment of the method according to the invention, the initial dewatering results in a dry content of the pulp suspensions which is between 2 and 3%.

In a particularly preferred embodiment of the method according to the invention, the continued dewatering primarily takes place in a direction towards the outer-wire sides y and w of the fibre webs A and B. In this embodiment, the highest possible content of retained fines is obtained at the inner-wire sides x and z, which thereafter are to be couched together, and consequently also the highest possible internal bond strength.

The continued dewatering particularly advantageously results in a dryness of the fibre webs A and B which is higher than about 6 to 8%. At such a relatively high dry content, the forming can be regarded as completed, and the fines present in the fibre webs are retained in a stable way even in case the fibre webs subsequently would be subjected to high vacuum (i.e. suction).

In one advantageous embodiment of the method according to the invention, particularly illustrated by FIG. 7, forming rolls 509, 511 having a diameter of about 1.4–1.8 m are chosen. Thereby, the wire winding angle is adapted to be at least 80°, wherein the initial dewatering results in a dry content of the pulp suspensions in the order of 6%. The continued dewatering results in a dry content of the fibre webs A and B which is higher than about 6–8%, wherein the continued dewatering is accomplished by means of one or several of the vacuum transfer means 513, 514.

In another advantageous embodiment of the method according to the invention, a few of the vacuum transfer means 113, 114; 213. 214: 313, 314, 327; 413, 414, 427 provide an additional dewatering after the continued dewatering, resulting in a dryness higher than about 8 to 10% of the fibre webs A and B before they are joined into the multilayered fibre web C. In this embodiment, the high content of fines at the inner-wire sides x and z which is obtained by means of the method according to the invention makes it possible to obtain a high internal bond strength.

In a first alternative embodiment of the method according to the invention, particularly illustrated by FIGS. 1 and 2 together with FIG. 5. a first fibre web A is transferred from the inner-wire 105; 205 to the outer-wire 106; 206 of the first forming unit 101; 201, while a second fibre web B is transferred from the inner-wire 107; 207 to the outer-wire 108; 208 of the second forming unit 102; 202 in order lo be transferred therefrom be onto the first fibre web A.

In a second alternative embodiment of the method according to the invention, particularly illustrated by FIGS. 3 and 4 together with FIG. 5, the method further comprises to form a bottom layer E on at least one bottom-wire 330; 430, and that the first fibre web A thereafter is transferred onto the bottom layer E. In this embodiment, the first fibre web A is particularly advantageously transferred from the outer-wire 306; 406 to the inner-wire 305; 405 of the first forming unit 301: 401 before the first fibre web A is transferred In a third alternative embodiment of the method according to the invention, particularly illustrated by FIGS. 2 and 4 together with 5, the method further comprises to form a top layer F on at least one top-wire 224; 424, and that the top layer F thereafter is transferred onto the second fibre web B.

The present invention should by no means be regarded as being limited to what has been disclosed above in connection with the different embodiments, or to what is shown in the attached drawings, but the scope of the invention is defined by the following claims.

In FIG. 1, an arrangement 100 according to the invention is shown in greater detail in a configuration which is particularly well suited for forming testliner or fluting having a top layer within the grammage range 30–100 g/m$^2$ and a base layer within the range 50–150 g/m$^2$. However, the arrangement could also be used when forming other types of paper or paperboard webs in cases where it is desired to form and couch together two different layers. As is evident from FIG. 1, a very compact and cost efficient unit is obtained in this configuration, since a number of t pans included in the two twin-wire forming units 101, 102 are identical in both units. Since the forming rolls 110, 111 arm open and are not vacuum suction rolls, no significant redistribution of fines takes place in the pulp suspension, and a relatively uniform sheet structure in the Z-direction can be obtained Furthermore, during the forming, the additional drainage members 110, 112 are acting exclusively on the outer-wire sides y and w, B, which are not to be couched together, of the fibre webs A and. For this reason, the content of fines at the opposing inner-wire sides x and z, which art to be couched together, remains unchanged at a high level (see FIG. 5).

FIG. 2 shows an arrangement 200 according to the invention in greater detail in a configuration which is particularly well suited for liner, "white top" liner, or gypsum hoard liner. However, this arrangement could also be utilised when forming other types of paper or paperboard webs where it is desirable to form and couch together three different plies. The arrangement 200 can be said to be of the type "Top-side Down", since a top layer is formed in the twin-wire forming unit 201, a middle layer is formed in the twin-wire forming unit 202, and a bottom layer is formed in the fourdrinier forming unit 222. The grammage of the top layer advantageously can be 40–80 g/m$^2$, of the middle layer 55–170 g/m$^2$, and of the bottom layer 30–50 g/m$^2$, but it is also conceivable with other grammage intervals.

FIG. 3 shows another arrangement 300 according to the invention in greater detail, also in a configuration which is particularly well suited for liner, "white top" liner or gypsum board liner. However, this arrangement could also be utilised when forming other types of paper or paperboard webs where it is desired to form and couch together three different layers. In contrast to the arrangement in FIG. 2, the arrangement In FIG. 3 is of the type "Top-side Up", i.e. a bottom layer is formed in the fourdrinier forming unit 328, a middle layer is formed in the twin-wire forming unit 301, and a top layer is formed in the twin-wire forming unit 302. The grammage of the bottom layer advantageously can be 43–80 g/m$^2$, of the middle layer 55–155 g/m$^2$, and of the top layer 40–65 g/m$^2{}_1$ but it is also conceivable with other grammage intervals.

FIG. 4 discloses an arrangement 400 according to the invention in greater detail, now in a configuration which is particularly well suited for liner or paperboard, and particularly for paperboard based on recycled fibres. However, this arrangement could also be utilised when forming other types of paper or paper webs where it is desirable to be able to form and couch together four different layers (sheets). In the arrangement in FIG. 4, a bottom layer is formed in the fourdrinier forming unit 428, a single middle layer or alternatively a first middle layer is formed in the twin-wire forming unit 402, an underliner or alternatively a second middle layer is formed in the twin-wire forming unit 402, and a top layer is formed in the fourdrinier forming unit 422. The grammage of the above-mentioned bottom layer can advantageously be 25–90 g/m$^2$, of the above-mentioned single middle layer 40–200 g/m$^2$, of the above-mentioned first middle layer 60–180 g/m$^2$, of the above-mentioned underliner 30–90 g/m$^2$, of the above mentioned second middle layer 60–180 g/m$^2$, and of the above-mentioned top layer 30–60 g/m$^2$. However. it is also conceivable with other grammage intervals.

When the different components included in the arrangement according to the invention are concerned, these can but do not necessarily have to be of a construction and function previously known per se, for example applicable components which are disclosed in the above-discussed documents with prior art.

Figure 6:
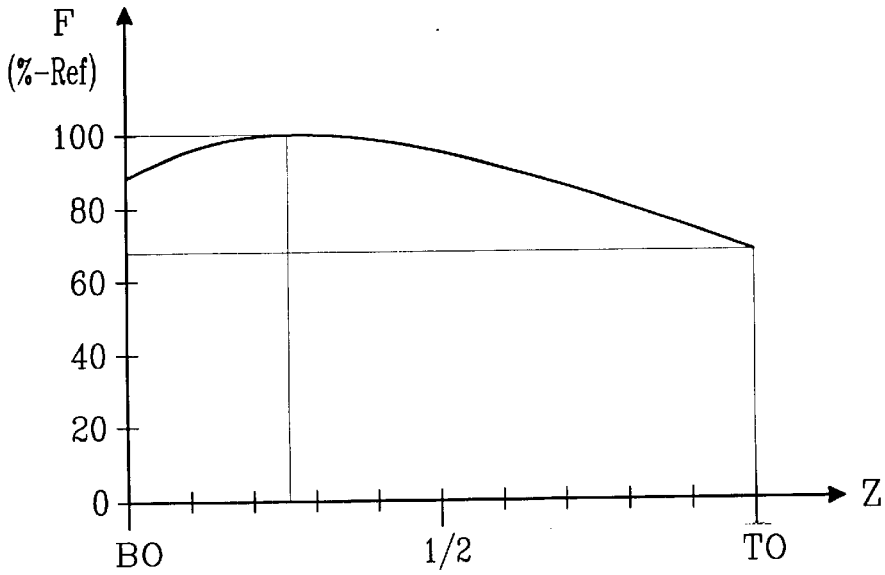

In the form of a diagram, the attached FIG. 6 illustrates the relative percentage of fines F as a function of the thickness Z of a first fibre web from the bottom BO to the top TO, wherein the first fibre web has been formed in a forming unit of an arrangement according to the invention, and a specimen for analysis of fines content has been extracted before joining to a second fibre web.

As is evident from FIG. 6, the relative proportion of fines at the bottom BO of the specimen is only slightly lower than the maximum proportion 100% slightly further into the thickness Z of the specimen, wherein it should be noted that the bottom BO of the specimen is the inner-wire side.

It should also be evident from FIG. 6 that the relative percentage of fines at die top TO of the specimen (i.e. the outer-wire side) is lower than at the bottom BO of the specimen, but still relatively high.

In case that two fibre webs with the fines distribution illustrated in FIG. 6 are couched together with their inner-wire sides BO against each other, a multilayered paper or paperboard web according to the invention with a very high internal bond strength is obtained after pressing and drying. Furthermore, the relatively high fines content at the outer-wire sides TO makes it possible to reach a high internal bond strength also after couching to further layers.

Furthermore, it should be noted that the arrangements 100; 200; 300; 400; 500 in FIGS. 1–4 and 7 all are provided with so-called forming boards 132, 133; 232, 233; 332, 333; 432, 433; 532, 533 with support foils inside the inner-wire loops downstream their forming rolls 109, 111; 209, 211; 309, 311; 409, 411; 509, 511. However, the wire tables/support foils shown in the figures do not provide any drainage function.

What is claimed is:

1. An apparatus for forming a multilayered paper or paperboard web from stock suspensions containing papermaking fibers and fines, the apparatus comprising:

a first forming unit including a forming roll, an inner wire, and an outer wire, the first forming unit being operable to produce a fiber web having a higher concentration of fines at one side than at an opposite side of the web;

a second forming unit including a forming roll, an inner wire, and an outer wire, the second forming unit being operable to produce a fiber web having a higher concentration of fines at one side than at an opposite side of the web; and a couch device for couching together the webs from the first and second forming units, wherein the forming units and couch device are arranged relative to one another so as to place the sides of the webs having the higher concentration of fines in contact with each other for couching together to form the multilayered web; and wherein each of the forming units is arranged such that the inner and outer wires pass along a portion of the circumference of the forming roll to form an initial curved section of a forming zone in which initial dewatering takes place so as to form a web having an inner wire side against the inner wire and an outer wire side against the outer wire, wherein said curved section is followed by a section having additional drainage members operable to further dewater the web, and wherein the forming roll is an open forming roll operable to produce a higher concentration of fines at the inner wire side of the web than at the outer wire side.

2. The apparatus of claim 1, wherein the additional drainage members are arranged adjacent the outer wires for dewatering the webs from the outer wire sides thereof.

3. The apparatus of claim 2, wherein the additional drainage members include vacuum suction boxes.

4. The apparatus of claim 3, wherein at least one of the vacuum suction boxes, in addition to dewatering the respective web, is arranged to transfer the web from the inner wire onto the outer wire.

5. The apparatus of claim 3, wherein at least one of the vacuum suction boxes, in additional to dewatering the respective web, is arranged to join the webs together to form the multilayered web.

6. The apparatus of claim 1, further comprising vacuum transfer devices arranged for joining the webs together to form the multilayered web.

7. The apparatus of claim 6, wherein at least one of the vacuum transfer devices also comprises an additional drainage member for continued dewatering of the web.

8. The apparatus of claim 1, wherein at least the forming rolls, additional drainage members, and wires are identical between the first and second forming units.

9. The apparatus of claim 8, further comprising drive rolls and tensioning rolls for the forming units, wherein the drive rolls and tensioning rolls are identical between the first and second forming units.

10. The apparatus of claim 1, further comprising a first vacuum transfer device arranged for transferring the web formed in the first forming unit from the inner wire onto the outer wire thereof, a second vacuum transfer device arranged for transferring the web formed in the second forming unit from the inner wire onto the outer wire thereof, and a third vacuum transfer device arranged for transferring the web formed in the second forming unit from the outer wire thereof onto the web formed in the first forming unit.

11. The apparatus of claim 1, further comprising a bottom layer forming unit for forming a bottom layer to be joined with the webs formed in the first and second forming units, the bottom layer forming unit having at least one bottom wire and a headbox for forming the bottom layer on the bottom wire, and further comprising at least one vacuum transfer device arranged for transferring the web formed in the first forming unit onto the bottom layer on the bottom wire.

12. The apparatus of claim 11, further comprising at least one additional vacuum transfer device arranged for transferring the web formed in the first forming unit from the outer wire onto the inner wire thereof.

13. The apparatus of claim 1, further comprising a top layer forming unit for forming a top layer to be joined with the webs formed in the first and second forming units, the top layer forming unit having at least one top wire and a headbox for forming the top layer on the top wire, and further comprising at least one vacuum transfer device arranged for transferring the top layer onto the web formed in the second forming unit.

14. A method for forming a multilayered paper or paperboard web from stock suspensions containing papermaking fibers and fines, the method comprising:

forming a first fiber web having a higher concentration of fines at one side than at an opposite side thereof, the first web being formed in a first twin-wire forming unit;

at an opposite forming a second fiber web having a higher concentration of fines at one side than at an opposite side thereof, the second web being formed in a second twin-wire forming unit; and couching the webs together with the sides having a higher concentration of fines in contact with each other; and wherein each forming unit comprises a forming roll, an inner wire, and an outer wire arranged such that the inner and outer wires pass along a portion of the circumference of the forming roll to form an initial curved section of a forming zone in which initial dewatering takes place so as to form a web having an inner wire side against the inner wire and an outer wire side against the outer wire, wherein continued dewatering of the web is performed after said curved section by additional drainage members operable to further dewater the web, and wherein the forming roll is an open forming roll operable to produce a higher concentration of fines at the inner wire side of the web than at the outer wire side.

15. The method of claim 14, wherein the initial dewatering results in the webs having a dryness of about 2 to 3 percent.

16. The method of claim 15, wherein the continued dewatering results in the webs having a dryness greater than about 6 percent.

17. The method of claim 14, wherein the continued dewatering occurs primarily in a direction toward the outer wire sides of the webs.

18. The method of claim 14, wherein the forming rolls have a diameter of about 1.4 to 1.8 m and the wires are wrapped about the forming rolls with a wrap angle of at least about 80°.

19. A method for forming a multilayered paper or paperboard web from stock suspensions containing papermaking fibers and fines, the method comprising:

forming a first fiber web having a higher concentration of fines at one side than at an opposite side thereof, the first web being formed in a first twin-wire forming unit;

forming a second fiber web having a higher concentration of fines at one side than at an opposite side thereof, the second web being formed in a second twin-wire forming unit; and couching the webs together with the sides having a higher concentration of fines in contact with each other;

wherein each forming unit comprises an open forming roll, an inner wire, and an outer wire arranged such that the inner and outer wires pass along a portion of the circumference of the forming roll to form an initial curved section of a forming zone in which initial dewatering takes place so as to form a web having an inner wire side against the inner wire and an outer wire side against the outer wire, wherein continued dewatering of the web is performed after said curved section by additional drainage members operable to further dewater the web; and wherein the initial dewatering results in the webs having a dryness of about 6 percent, and the continued dewatering results in the webs having a dryness greater than about 6 percent.

20. The method of claim 19, wherein the continued dewatering is performed by at least one vacuum transfer devices.

21. The method of claim 20, further comprising using vacuum transfer devices to perform additional dewatering after the continued dewatering so as to achieve a dryness of the webs greater than about 8 percent before the webs are couched together to form the multilayered web.

22. A method for forming a multilayered paper or paperboard web from stock suspensions containing papermaking fibers and fines, the method comprising:

forming a first fiber web having a higher concentration of fines at one side than at an opposite side thereof, the first web being formed in a first twin-wire forming unit;

forming a second fiber web having a higher concentration of fines at one side than at an opposite side thereof, the second web being formed in a second twin-wire forming unit; and couching the webs together with the sides having a higher concentration of fines in contact with each other; and a wherein the first web formed in the first forming unit is transferred from the inner wire onto the outer wire thereof which is arranged to pass adjacent to the outer wire of the second forming unit, and wherein the second web formed in the second forming unit is transferred from the inner wire onto the outer wire thereof and is transferred from the outer wire of the second forming unit onto the first web that is on the outer wire of the first forming unit.

23. A method for forming a multilayered paper or paperboard web from stock suspensions containing papermaking fibers and fines, the method comprising:

forming a first fiber web having a higher concentration of fines at one side than at an opposite side thereof, the first web being formed in a first twin-wire forming unit;

forming a second fiber web having a higher concentration of fines at one side than at an opposite side thereof, the second web being formed in a second twin-wire forming unit;

couching the webs together with the sides having a higher concentration of fines in contact with each other; and forming a bottom layer on at least one bottom wire, and thereafter transferring the first web onto the bottom layer.

24. The method of claim 23, wherein the first web, prior to being transferred onto the bottom layer, is transferred from the outer wire onto the inner wire of the first forming unit.

25. A method for forming a multilayered paper or paperboard web from stock suspensions containing papermaking fibers and fines, the method comprising:

forming a first fiber web having a higher concentration of fines at one side than at an opposite side thereof, the first web being formed in a first twin-wire forming unit;

forming a second fiber web having a higher concentration of fines at one side than at an opposite side thereof, the second web being formed in a second twin-wire forming unit;

couching the webs together with the sides having a higher concentration of fines in contact with each other; and forming a top layer on at least one top wire and thereafter transferring the top layer onto the second web.

* * * * *

UNITED STATES PATENT AND TRADEMARK OFFICE

CERTIFICATE OF CORRECTION

PATENT NO. : 6,413,369 B2
DATED : July 2, 2002
INVENTOR(S) : Kinnunen

It is certified that error appears in the above-identified patent and that said Letters Patent is hereby corrected as shown below:

Title page,
Item [60], Related U.S. Application Data, "60/171,974" should read -- 60/171,979 --.

Column 11,
Line 62, cancel "at an opposite".

Column 13,
Line 7, cancel "a".

Signed and Sealed this

Fifteenth Day of June, 2004

JON W. DUDAS
*Acting Director of the United States Patent and Trademark Office*